US011920896B2

(12) United States Patent
Theisinger et al.

(10) Patent No.: US 11,920,896 B2
(45) Date of Patent: Mar. 5, 2024

(54) HANDGUN SIGHT

(71) Applicants: Hermann Theisinger, Vienna (AT); Alexander Peter Cavasin, Surin (TH)

(72) Inventors: Hermann Theisinger, Vienna (AT); Alexander Peter Cavasin, Surin (TH)

(73) Assignee: SUPAS LTD, Central (HK)

( * ) Notice: Subject to any disclaimer, the term of this patent is extended or adjusted under 35 U.S.C. 154(b) by 0 days.

(21) Appl. No.: 17/154,550

(22) Filed: Jan. 21, 2021

(65) Prior Publication Data

US 2021/0222998 A1 Jul. 22, 2021

Related U.S. Application Data

(60) Provisional application No. 62/963,611, filed on Jan. 21, 2020.

(51) Int. Cl.
*F41G 1/30* (2006.01)
*F41G 1/34* (2006.01)
*F41G 3/06* (2006.01)

(52) U.S. Cl.
CPC ..... *F41G 1/30* (2013.01); *F41G 1/345* (2013.01); *F41G 3/065* (2013.01)

(58) Field of Classification Search
CPC ... F41G 1/30; F41G 1/345; F41G 1/35; F41G 3/065
USPC ..... 42/111, 113–114
See application file for complete search history.

(56) References Cited

U.S. PATENT DOCUMENTS 2,596,522 A * 5/1952 Bethke ..... F41G 1/30 42/113
3,565,539 A * 2/1971 Russa ..... G02B 27/0149 359/859
3,833,799 A * 9/1974 Audet ..... F41G 1/345 362/800
4,418,487 A * 12/1983 Strahan ..... F41G 11/001 42/125
4,533,980 A * 8/1985 Hayes ..... F41G 1/345 362/249.05
5,107,612 A * 4/1992 Bechtel ..... F41G 11/003 42/146
5,369,888 A * 12/1994 Kay ..... G02B 23/00 356/252
5,483,362 A * 1/1996 Tai ..... G03H 1/2286 42/114
5,735,070 A * 4/1998 Vasquez ..... F41G 1/345 42/132
5,815,936 A * 10/1998 Sieczka ..... G03H 1/0005 42/114
6,640,482 B2 * 11/2003 Carlson ..... F41G 1/345 42/132

(Continued)

*Primary Examiner* — Joshua E Freeman
*Assistant Examiner* — Benjamin S Gomberg
(74) *Attorney, Agent, or Firm* — Ian F. Burns; ATIP Law

(57) ABSTRACT

A static reflex sight for a handgun can reduce parallax errors and improve accuracy by locating electronic components of the sight in compartments disposed below the slide of the handgun rather than above. Only the sight lens and light projection point need be located in an upper mounting portion situated above the slide. An electronics compartment connected to the upper mounting portion by a side mounting portion can house an LED, battery and control electronics. An optic fiber conveys light from the LED to the light projection point which projects light onto the lens.

15 Claims, 8 Drawing Sheets

(56) References Cited

U.S. PATENT DOCUMENTS

| | | | | |
|---|---|---|---|---|
| 7,069,685 | B2 | 7/2006 | Houde-Walter | |
| 7,145,703 | B2 * | 12/2006 | Sieczka | G02B 23/14 42/130 |
| 7,194,836 | B1 * | 3/2007 | Urban | F41C 27/22 89/14.05 |
| 7,721,481 | B2 * | 5/2010 | Houde-Walter | F41G 1/30 42/131 |
| 8,393,108 | B1 * | 3/2013 | Wilson | F41G 11/003 42/111 |
| 8,714,072 | B1 * | 5/2014 | Villarreal | F41G 3/165 42/130 |
| 9,470,480 | B2 * | 10/2016 | Kirchhoff | F41G 11/001 |
| 9,869,531 | B1 * | 1/2018 | Zimmer | F41G 11/001 |
| 10,378,856 | B2 * | 8/2019 | Harrison | F41G 1/35 |
| 2004/0211105 | A1 * | 10/2004 | Arachequesne | F41G 1/02 42/113 |
| 2006/0164704 | A1 | 7/2006 | Sieczka | |
| 2014/0157644 | A1 * | 6/2014 | Jiminez | F41G 11/003 42/114 |
| 2018/0372448 | A1 * | 12/2018 | Noskowicz | F41G 1/30 |

* cited by examiner

HANDGUN SIGHT

CROSS REFERENCE TO RELATED APPLICATIONS

This application claims priority to U.S. provisional patent application Ser. No. 62/963,611, filed 21 Jan. 2020, the contents of which are herein incorporated by reference.

FIELD OF THE INVENTION

The present invention relates to sights for use on handguns.

BACKGROUND

Reflex sights have been used with firearms. Reflex sights provide a light source, such as alight emitting diode (LED), and a lens. The light is projected onto a lens and the lens reflects the light spot back to the eye of the firearm user who, looking through the lens, uses the light spot as a reference for aiming the firearm.

The typical components of a reflex sight include a lens, light source (LED), windage and elevation adjustments, battery, controls, pinted circuit board (PCB), control electronics and housing. Most reflex sights position the battery, controls and adjustments in a lower housing and the lens and LED attached to the top of the housing. The entire reflex sight can then be mounted on top of a handgun.

Unlike rifles or long barrel firearms that generally do not have upper moving parts, the upper part of many modern handguns provide a moving slider that facilitates reloading of the handgun, either manually or automatically. The slider presents an issue for top mounted sights. A reflex sight can be directly mounted to the slider of a handgun. A direct mount has the advantage that the sight has a low mounting position meaning that the line of sight most accurately aligns with the line of the barrel, reducing any parallax errors. Slider mounted sights are compact and have simple mountings. A disadvantage of slider mounted sights is that the slider moves during firing and requires the user to reacquire the sighting dot in order to accurately target the next shot. This can be an issue when rapid firing is required. In addition, the mass of the sight may significantly change the motion of the slider, thereby interfering with the operation of the slider, and the repeated acceleration of the sight on the slider may cause alignment and adjustments to change over time.

An alternative to slider mounted sights is to provide a static mounted sight that mounts to the frame of the handgun via a more complex mounting arrangement. An embodiment of a prior art static sight is depicted in FIG. 1. In this embodiment, the arrangement 100 includes a sight 110 and a mount 130. The sight includes a lens 112 and LED 114. The lens 112 and LED 114 are provided on top of housing compartment 116 which houses adjustments 118 and an internal battery. The lens mount may include a ring 122 into which the lens is located. The lens ring may be integral and unitary with the housing compartment 116.

The mount 130 includes side portions 132, 134 extending downward of the housing compartment 116. FIG. 2 shows a prior art sight that is statically mounted to the frame of a handgun 150. A lower edge of the side components 132 may include fixing points through which the mount 130 may be secured to the handgun frame, or to a rail located below the barrel.

In use, the mount 130 is secured to the handgun frame and locates the sight 110, including the battery 156 and adjustments 154 at an elevated position above the slider of the handgun with sufficient clearance such that the sight does not interfere with operation of the slider. Because of the requirement for this clearance, the sight is mounted higher than for a direct or slider mounted system. Thus, while the sight is now static during shooting, the higher mounting position raises the sighting line 152 of the sight and introduces parallax errors making the handgun less accurate.

What is required is an improved mounting system for a firearm.

SUMMARY OF ONE EMBODIMENT OF THE INVENTION

Advantages of One or More Embodiments of the Present Invention

The various embodiments of the present invention may, but do not necessarily, achieve one or more of the following advantages:

- provide a static mounted handgun sight;
- provide a static mounted handgun sight with a low sighting line;
- ability to locate non-essential components of the sight adjacent or below the handgun barrel;
- ability to support a longer life battery; and
- ability to locate additional accessories for a handgun sight.

These and other advantages may be realized by reference to the remaining portions of the specification, claims, and abstract.

BRIEF DESCRIPTION OF ONE EMBODIMENT OF THE PRESENT INVENTION

In one aspect of the present invention, there is provided sight for a handgun, the sight comprising at least one upper mounting portion that is configured to be mounted above an upper surface of a slider of the handgun when the sight is mounted to the handgun. The at least one upper mounting portion may comprise at least one lens and at least one light projection point that is configured to project light onto the at least one lens. The sight may comprise at least one light source that provides light to the light projection point. An electronics compartment may comprise at least one battery and control electronics for operating the at least one light source. At least one side mounting portion may extend between the at least one upper mounting portion and the at least one electronics compartment such that, when the sight is mounted to the handgun, the electronics compartment is located below the upper surface of the slider.

In one aspect of the present invention, there is provided sight for a handgun. The sight may comprise upper mounting means for supporting lens means and light projection means for projecting light onto the lens means. The sight may comprise light source means for providing light to the lens means. Electronics compartment means may house at least one battery means and control electronics means for operating the light source means. Side mounting means may extend between the upper mounting means and the electronics compartment means, the side mounting means for locating the electronics compartment below an upper surface of a slider of the handgun.

In one aspect of the present invention, there is a provided a sight for a handgun. The sight may include an upper mounting portion, a lens accommodated by the upper mounting portion and a light projection point accommodated by the upper mounting portion. The sight may include one or more electronics compartments that accommodate a battery and control electronics for operating the light source. The sight may include one or more side mounting portions extending from the upper mounting portion and configured to mount the sight to a handgun. The one or more side mounting portions are configured to mount to a handgun to locate the upper mounting portion above a barrel of the handgun. The one or more side mounting portions are further configured to locate the one or more electronics compartments at a location to a side or below a barrel of the handgun.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 3:
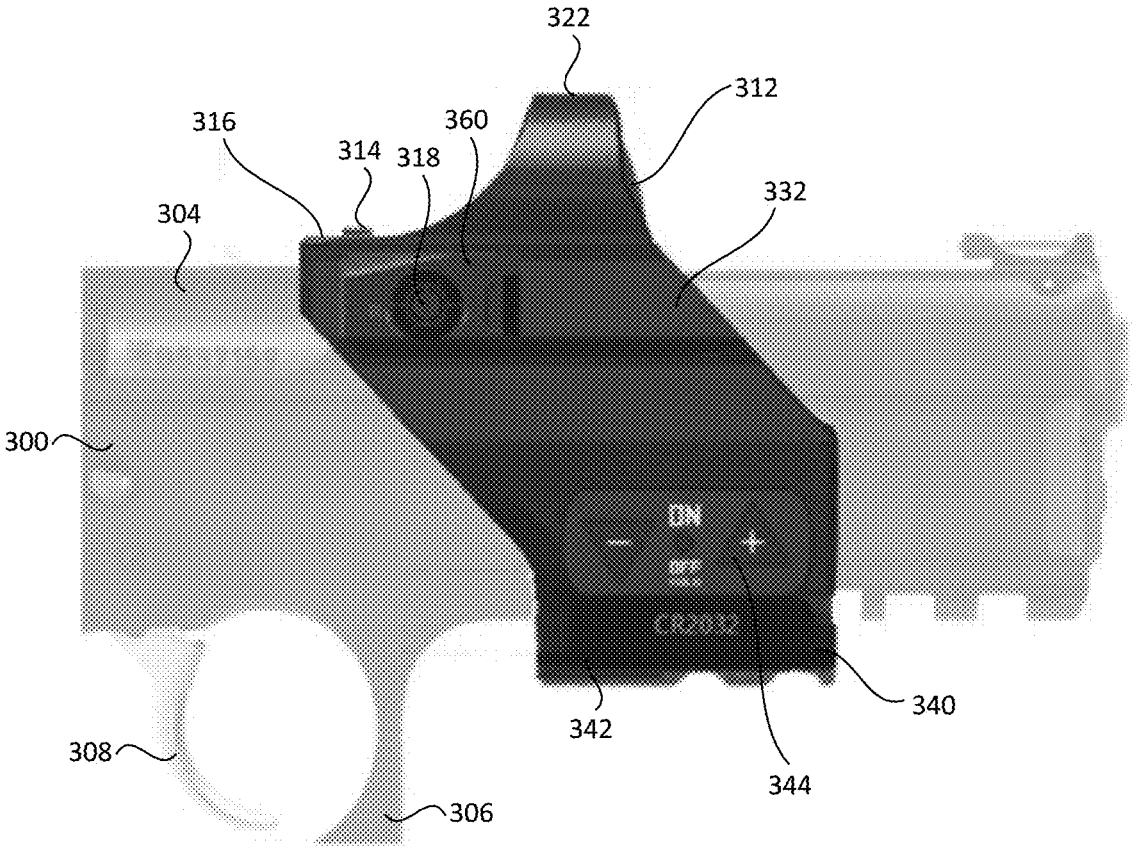
FIG. 3 substantially shows a static sight mount in accordance with an embodiment of the present invention, mounted to a handgun.

FIG. 3 shows a forward portion of a handgun 300 onto which a sight 310 in accordance with an embodiment of the invention has been mounted. The sight 310 may be considered a unitary sight in which the sight and mount are integrated. The sight 310 includes a lens 312, light projection point 314, adjustment 318, control components and battery. For the present embodiment however, the present inventors have recognized that only the light projection point and the lens are required to be located above the gun slider level of the handgun. The remainder of the components may be located below the gun slider level, e.g. either to the side of and/or below the barrel. By merging the mount and sight as one unit and moving as many of the sight's components below the gun slider level as possible, the sighting line through the lens element may be made as close to the barrel line as possible, thereby reducing parallax errors and improving accuracy.

In the embodiment of FIG. 3, the light projection point includes a light source such as an LED or surface mount device (SMD) and associated circuitry, e.g. a circuit board mounted LED. The light source and circuitry is mounted above the gun slider level. The LED projects light directly onto the lens. In an alternative embodiment, described below, the light source may also be remotely located below the gun slider level. An optical fiber, light pipe or other light conducting device may extend from the light source to the light projection point. The end of the optical fiber at the light projection point may project light redirected from the light source onto the lens. The light source may be an LED/SMD that is located in a housing disposed below the gun slider.

The sight 310 includes an upper mounting portion 316. The upper mounting portion, in use, extends across, and is located above, the barrel of the handgun in a normal upright configuration of the handgun. The upper mounting portion 316 includes a lens ring 322 that locates a sighting lens 312. Aft of the lens ring 322, the upper mounting portion 316 houses a light source 314, e.g. an LED that provides a light projection point.

The sight 310 includes side mounting portions of which only the left side 332 is shown in FIG. 3. While it may be possible to have a single side mounting portion, two spaced adjacent side mounting portions are provided that extend downwards from lateral lower edges of the upper housing portion. The side mounting portions are integrally formed with the upper housing portion, i.e. as a single piece of material. In use, i.e. when mounted to a handgun, the side mounting portions 332 are located to the side of the barrel 304.

The side mounting portions 332 extend downward and are interconnected by a lower housing portion 340. In use, the lower housing portion 340 is located below the barrel 304 of the handgun. The lower housing portion 340 is located under the barrel and forward of the trigger guard 306 in a manner such that it does not interfere with the grip on the handgun nor operation of the trigger 308.

One or both of the side mounting portions may include a side housing compartment 360 that houses one or more components associated with the sight. In the embodiment depicted, the side housing compartment 360 houses adjustment components 318 that can be actuated to affect the sighting line of the sight 310. Typically, the adjustment components 318 will include one or more rotatable components, such as screws or dials though other adjustment mechanisms may be apparent to the person skilled in the art. In use, the one or more adjustment components are located to the side of the barrel. The adjustment components connect to one or both of the light projection point and/or the lens and are configured to shift the light projection point or lens when operated to affect the sighting line of the sight. In one embodiment, the adjustment components may include one or more gears that transmit movement of the adjusting screws to the LED holder and/or the lens.

The lower housing portion 340 includes an electronics housing compartment 342. The electronics housing compartment houses control circuitry, e.g. a circuit board, and a battery compartment that receives a replaceable battery. The battery compartment may be removable from the electronics housing compartment 340. User controls, such as control buttons 344 may be located on an external face of the electronics housing compartment and/or the side compartment and penetrate through to the control circuitry. Actuation or operation of the control circuitry may control functions of the sight. Typical functions may include basic on/off function, intensity + and –, battery check functions, and in some embodiments, a color change function. In one embodiment, the electronics compartment 342 and control buttons 344 may be located in an ergonomic position so that the controls 344 may be activated with the user's fingers while the user maintains their grip on the handgun.

Figure 1:
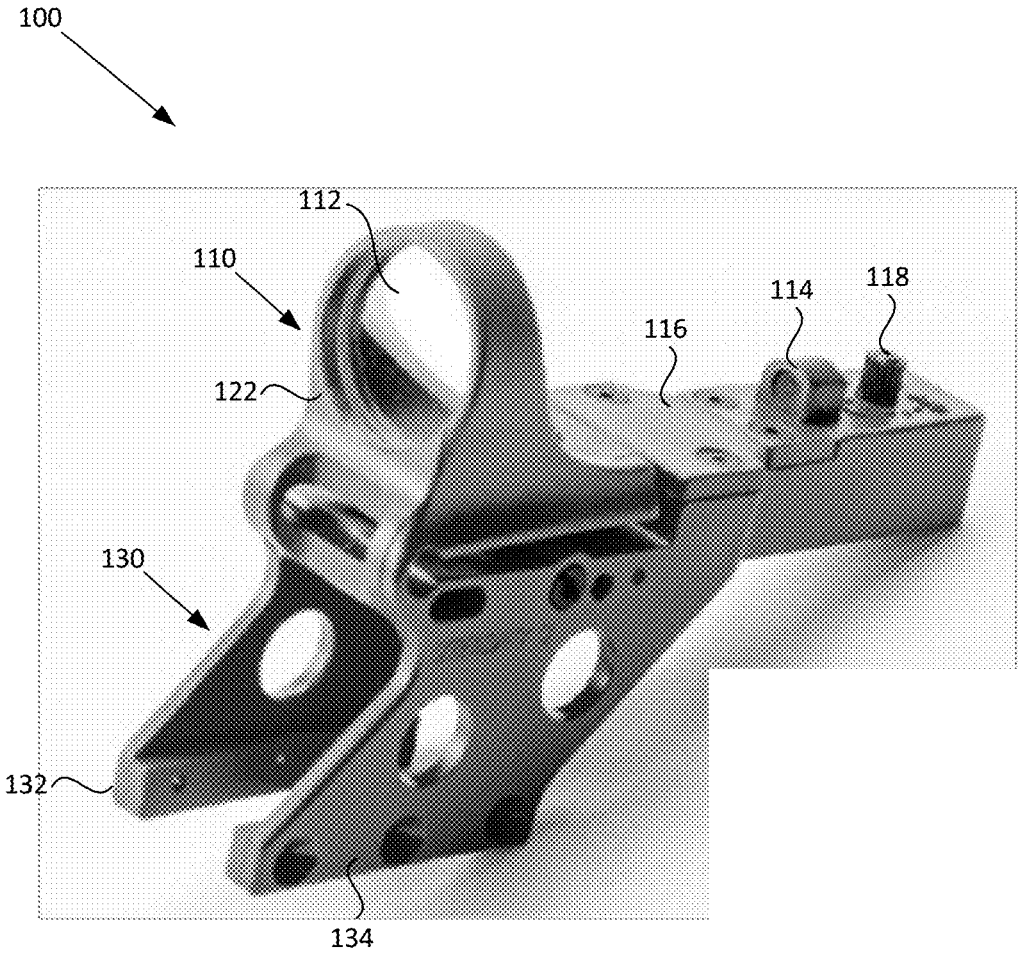
Fig. 1 (Prior Art)
FIG. 1 substantially shows a prior art static sight mount.
Figure 2:
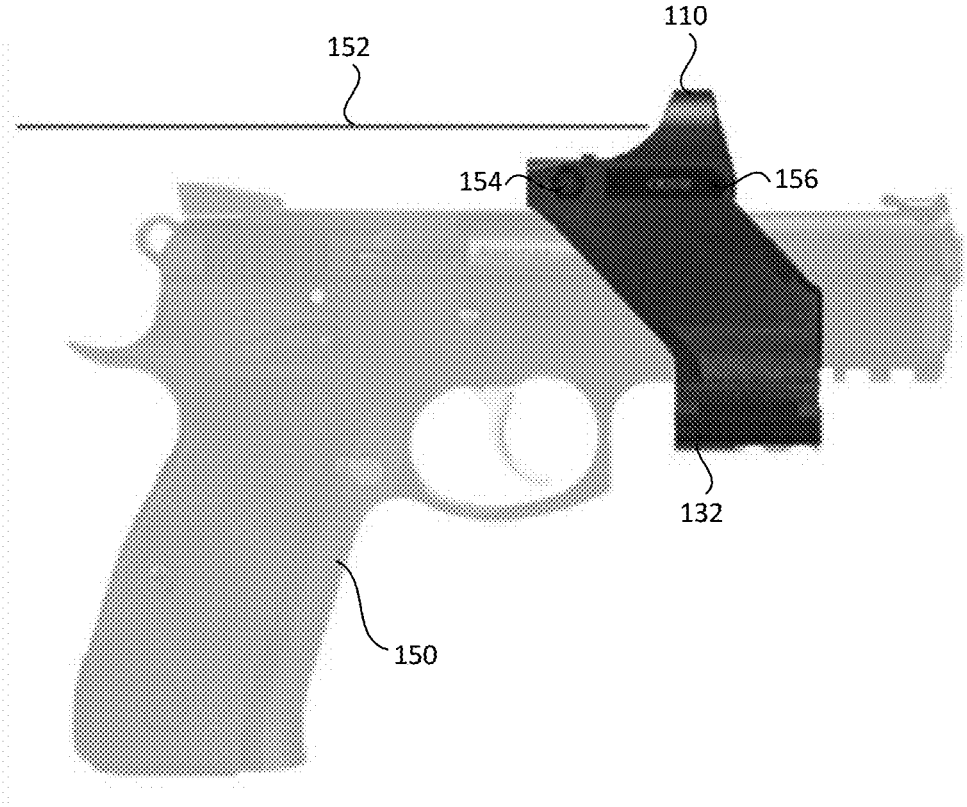
Fig. 2 (Prior Art)
FIG. 2 substantially shows a prior art static sight mount mounted to a handgun.

In the prior art sight of FIG. 1, the LED is mounted directly above the battery compartment allowing the LED to plug directly into the circuit board. In the present embodiment however, because the LED and the battery compartment are not co-located or immediately adjacent, additional wiring is required to connect the control circuitry to the LED to deliver power and/or any control signals. In one embodiment, the side mounting portion 332 accommodates one or more wires from the electronics compartment 342 to the LED 314. The wires may be individual strands or may be provided in a wiring harness or loom. Connectors may be provided at the ends of the wires for easy plug-in connection to the LED and to the control circuitry. The wiring may include one or more flexprints which are both flat and shockproof.

Figure 4:
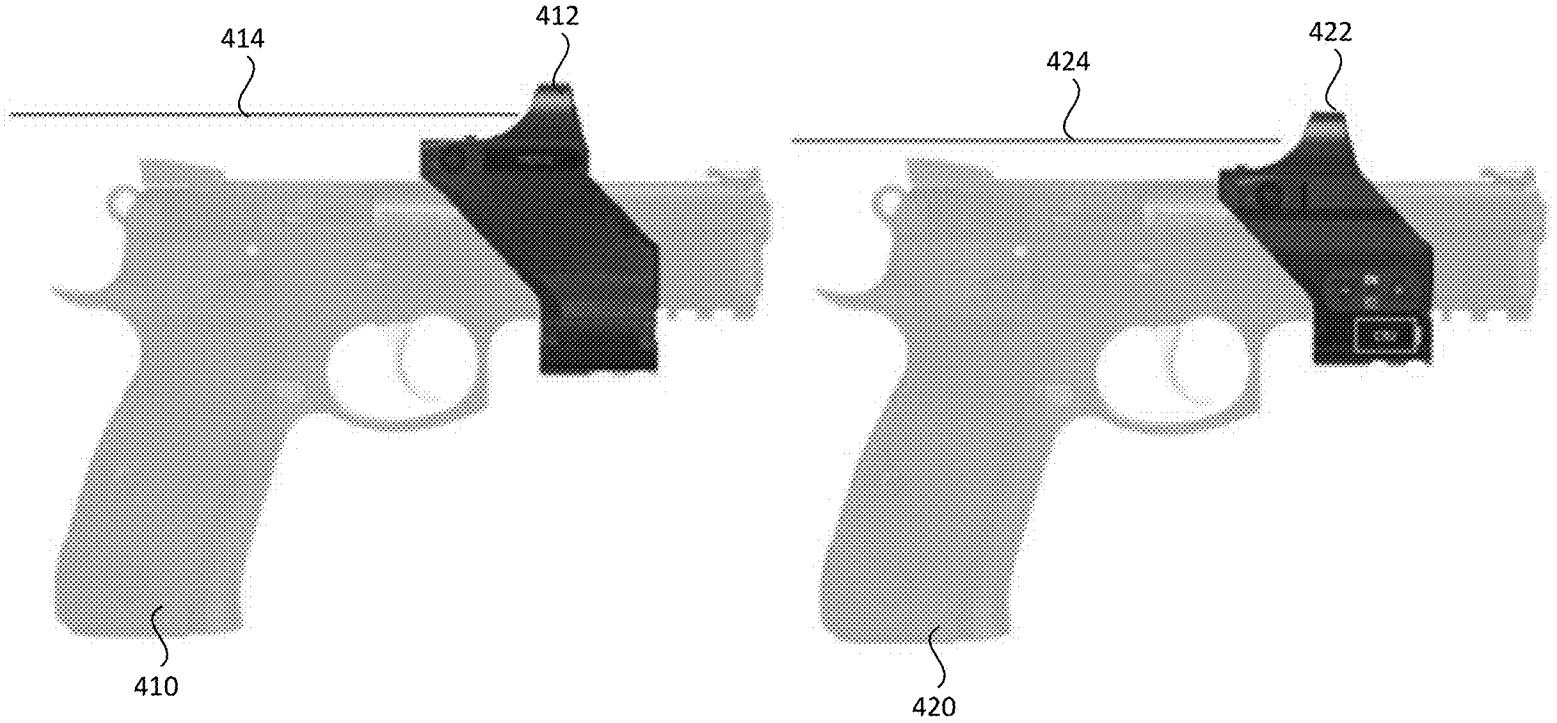
FIG. 4 substantially shows a comparison of sighting lines of static mount sights.

The lens 312 and light source 314 have been effectively lowered toward the barrel by the height of the battery compartment, potentially allowing, in some embodiments, the sight to be even lower than for a direct or slider mounted sight. FIG. 4 shows a side by side comparison of a handgun 410 with a prior art static mounted sight 412 (left side) and a handgun 420 with the static mounted sight 422 of FIG. 3 (right side). The sighting lines of each sight 414, 424 are illustrated. It can be seen that the static mounted sight on the right has a lower sighting line 424 that is closer to the barrel.

Figure 5:
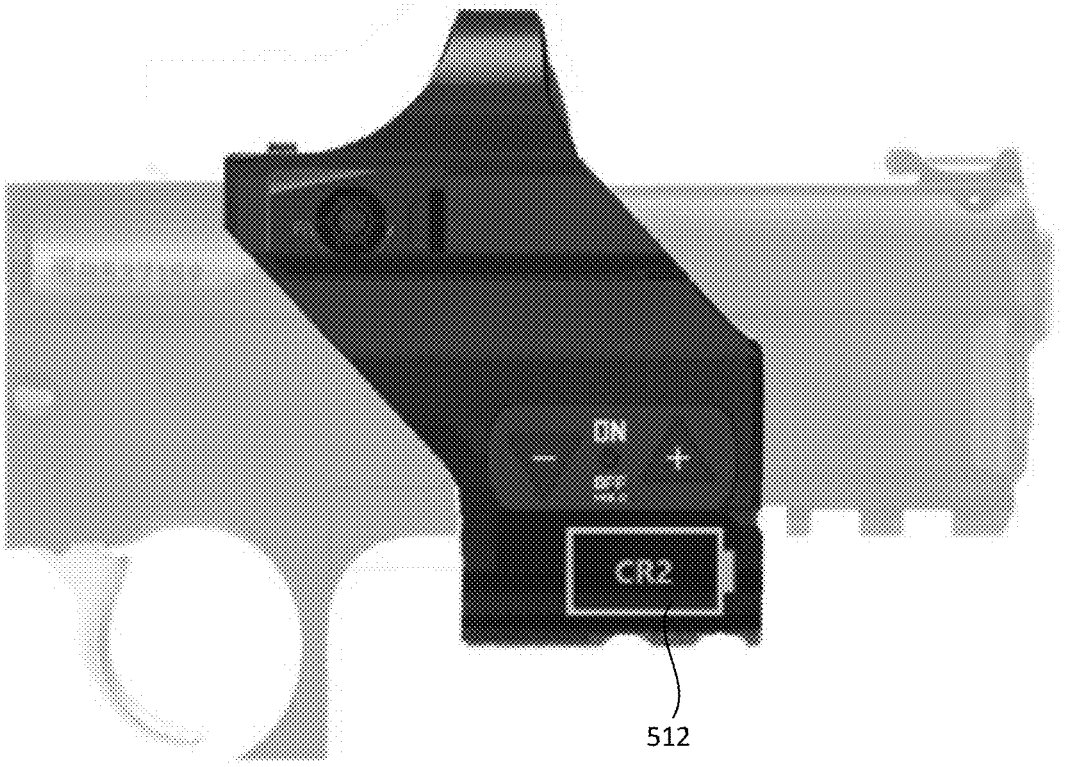
FIG. 5 substantially shows a static sight mount having an enlarged battery.

In the embodiment of FIG. 3, the battery compartment receives a low profile battery, such as a CR2032 battery. Such batteries are typical in the prior art sights and are sufficient for providing the basic functions of the optical sight at a reasonable longevity. The CR2032 provides a compromise between a sufficient battery life and power, and a low profile design that does not unduly raise the height of the sight which has heretofore been necessary for the prior art sights such as shown in FIG. 1. In the integral sight and mount shown in FIG. 3 with the battery compartment located beneath the barrel, the low profile requirements are no longer paramount. FIG. 5 shows an embodiment with an enlarged battery compartment 512 that is configured to receive a larger battery, such as a CR2 battery. By providing a battery with greater capacity, greater longevity can be achieved.

Figure 6:
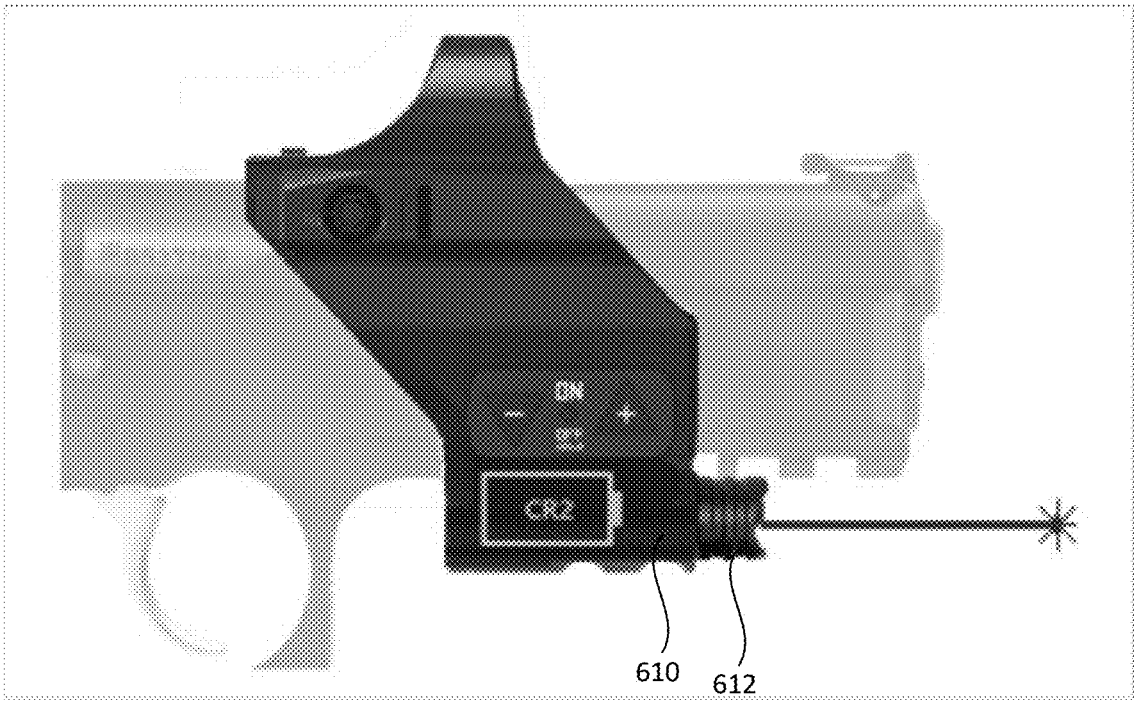
FIG. 6 substantially shows a static sight mount with an additional accessory mount.

A higher capacity battery and the less stringent profile requirements enable the integrated sight and mount to accommodate further powered accessories. In the embodiment of FIG. 6, electronics compartment 610 accommodates the mounting of a laser sight 612 on the front of the electronics compartment. Additional accessories may include flashlights and strobes. Control circuitry for controlling these accessories may be integrated into the control buttons or may be provided on the accessory. The interface between the accessory and the electronics compartment may provide automatic electrical engagement such that power can be supplied to the accessory as a result of the accessory being connected to the electronics compartment.

The side mounting portions of the sight may be configured to mount to an under-barrel rail, such as a Picatinny rail, to secure the sight to a handgun. In alternative embodiments, the sight may be specifically configured for certain handguns and make use of custom attachment points, such as an extended trigger pin that holds the rear end of the mount for better stability.

At least the upper mounting portion 316, side housing compartment 360 and electronics housing compartment 342 may be made waterproof or weather resistant to protect the components located within these respective compartments.

Figure 7:
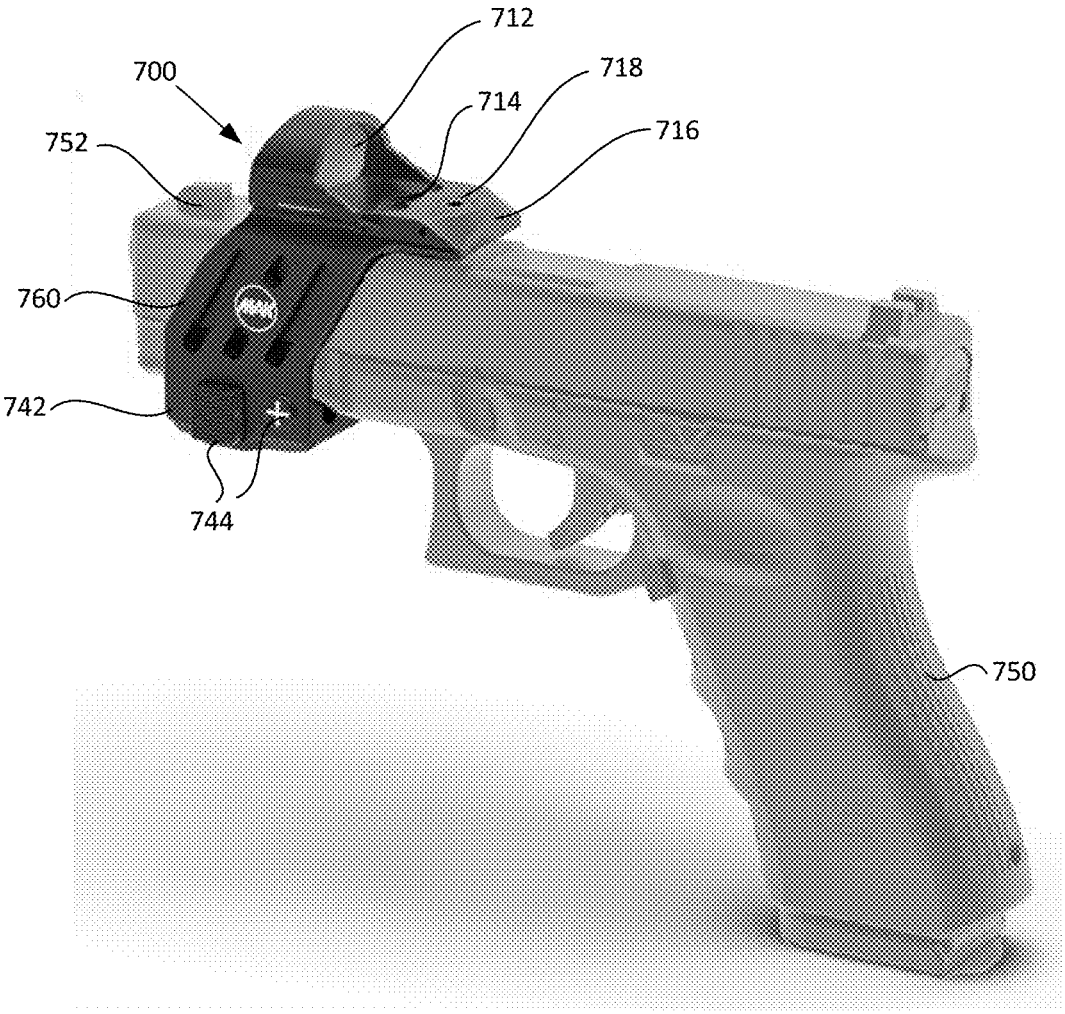
FIG. 7 substantially depicts an alternative embodiment of a static sight mount comprising a light source located in the electronics compartment.

FIG. 7 depicts an alternative embodiment of the integrated sight 700 mounted to the barrel of a GLOCK™ handgun 750. The handgun sight 700 of FIG. 7 includes an upper mounting portion 716. A side mounting portion 760 extends from the upper mounting portion to an electronics compartment(s) 742. Within the electronics compartment(s) are located the battery and control circuitry as previously described. Control buttons 744 are located on an external face of the electronics compartment 742 and provide user control of the sight.

In addition, the electronics compartment 742 also houses the light source. That is, the light source may be an additional component that is located below the slider level. An optical fiber may be provided that extends from the light source within the electronics compartment to the light projection point 714. The sight 700 is shown with side mounting portions on one side only. The sight 700 is depicted as a left-side mount configuration, but can also be produced as a right side mount.

Figure 8:
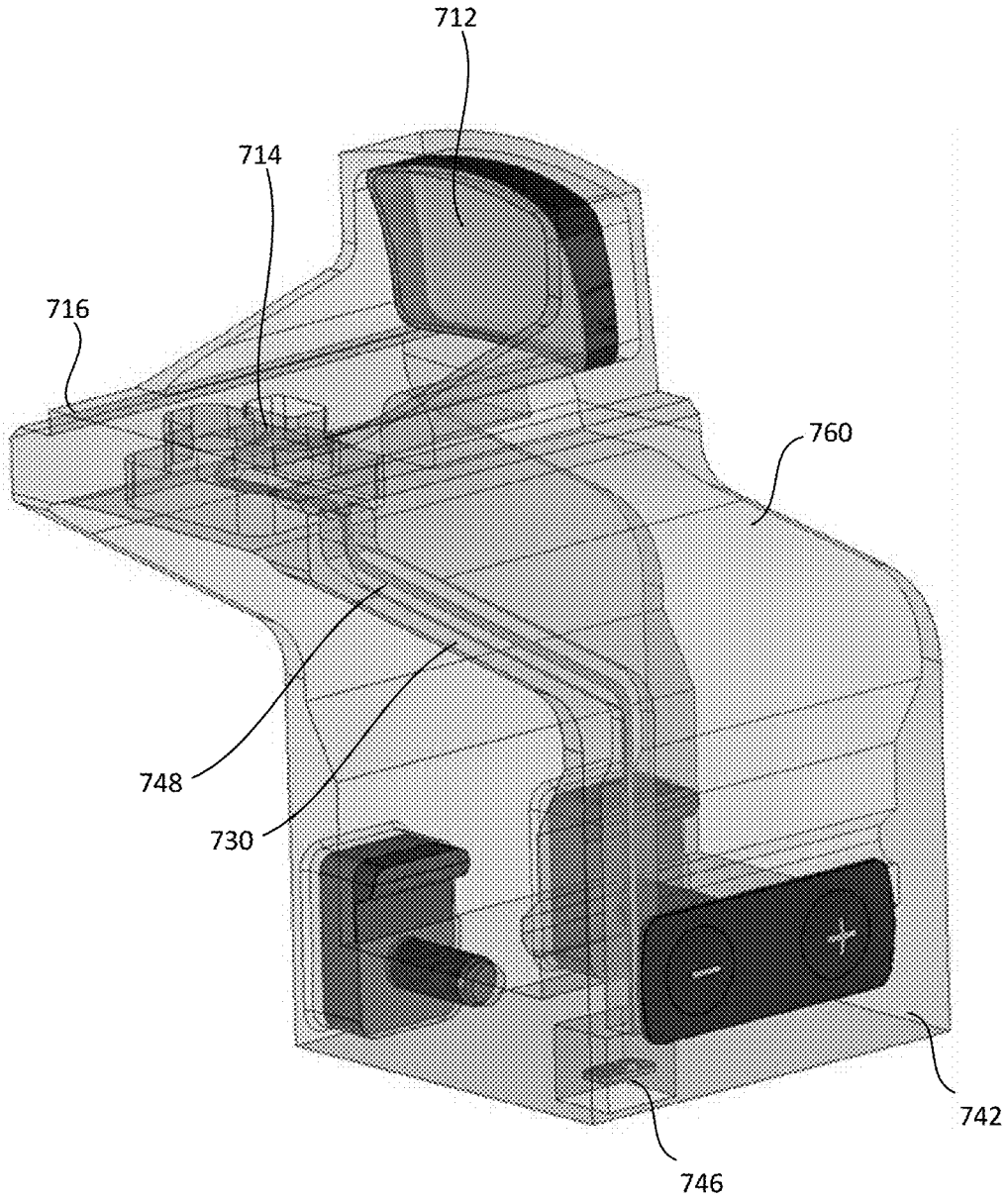
FIG. 8 substantially depicts an internal connection between the light source in the electronics department and the light projection point.

FIG. 8, provides an internal view of a portion of the sight where the light source is located within the electronics compartment remote from the upper mounting portion. The sight of FIG. 8 is a right-side mount configuration The electronics compartment 742 houses a circuit mounted LED or similar light source 746 and associated control circuitry. A guide channel 730 may be formed from the mounting of the LED circuit through the side mounting portion 760 and into the upper mounting portion 716. The guide channel 730 receives an optical fiber, light pipe or other light conducting device 748 that terminates at a light projection point 714 within the upper mounting portion 716. Light received into the optic fiber 748 from the LED 746 travels along the fiber to the light projection point 714 where it is directed onto the lens 712.

Using optical fiber at the light projection point delivers pointed light and consequently higher efficiency. The fiber (in contrast to board-mounted LEDs) has less mass and supports shock proofing efforts (less moving mass, only the tip of the fiber is tilted by elevation and windage). The guide channel 730 provides further shock proofing benefits. A further advantage is that waterproofing is not required on the upper mounting portion because all of the electronics and LED is contained elsewhere.

For the embodiment of FIG. 7, the GLOCK's original iron sights 752 remain in place, which requires the lens to be placed a few millimeters higher but gives room for the clicker mechanism 718 that provides windage and/or elevation adjustment to be located in the upper mounting portion 716. In an alternative embodiment, the sights 752 can be removed, allowing the lens to be lowered by approximately 2-3 mm, thereby improving accuracy. Alternatively, the sight may be reconfigured to allow the full range of slider motion with the sights in place, while still lowering the lens within the upper mounting portion. As shown in FIG. 7, the electronics compartment 742 must be located forward of the trigger yet the lens must be set far enough back that the sight 752 does not contact the lens mount during firing. The electronics compartment 742 is therefore offset forward of the upper mounting portion 716, with the side mounting portion being angled to account for this offset. By increasing the angle of the side mounting portion, the upper mounting portion may be located further back to allow for full range of the slider and sight, while still maintaining the lens position as low as possible.

While the embodiments depict the electronics compartment below the barrel, in an alternative embodiment, the electronics may be located in a side mounting portion of the sight.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A sight for a handgun, the sight comprising:

(a) at least one upper mounting portion that is configured to be mounted above an upper surface of a slide of the handgun when the sight is statically mounted to the handgun, the at least one upper mounting portion comprising:
  (i) at least one lens;
  (ii) at least one light projection point that is configured to project light onto the at least one lens;

(b) at least one light source;

(c) at least one electronics compartment comprising:
  (i) at least one battery;
  (ii) control electronics for operating the at least one light source;

(d) at least one side mounting portion extending between the at least one upper mounting portion and the at least one electronics compartment such that, when the sight is statically mounted to the handgun, the at least one electronics compartment is located below the upper surface of the slide, the at least one side mounting portion comprising:
  (i) one or more user controls located on an exterior surface of the at least one side mounting portion, the user controls connected to the control electronics; and
  (ii) an internal guide channel for receiving and guiding at least one of wiring and an optical fiber through the at least one side mounting portion from the at least one electronics compartment to the at least one upper mounting portion;

wherein the sight is configured to be statically mounted to a frame of the handgun with sufficient clearance such that the sight does not interfere with operation of the slide of the handgun.

2. The sight of claim 1 wherein the at least one light source is located in the at least one upper mounting portion at the at least one light projection point, wherein the at least one light source projects light directly onto the at least one lens.

3. The sight of claim 2 wherein the at least one of wiring and an optical fiber comprises wiring that extends from the control electronics to the at least one light source through the internal guide channel.

4. The sight of claim 1 wherein the at least one light source is located in the at least one electronics compartment, the at least one of wiring and an optical fiber comprising one or more optic fibers extending from the at least one light source to the at least one light projection point through the internal guide channel.

5. The sight of claim 1 wherein the at least one electronics compartment comprises a lower mounting portion that is located below a barrel of the handgun when the sight is mounted to the handgun, wherein the at least one battery is located in at least one battery compartment within the lower mounting portion.

6. The sight of claim 1 wherein the at least one battery comprises at least one CR2 battery.

7. The sight of claim 1 comprising at least one sight adjustment mechanism for adjusting at least one of windage and elevation.

8. The sight of claim 7 wherein the at least one sight adjustment mechanism is located in the at least one side mounting portion.

9. The sight of claim 1 comprising at least one laser sight mounted within the at least one electronics compartment.

10. A sight for a handgun, the sight comprising:

(A) upper mounting means for supporting:
  (a) lens means; and
  (b) light projection means for projecting light onto the lens means;

(B) light source means for providing light to the lens means;

(C) control electronics means for operating the light source means;

(D) electronics compartment means for housing at least one battery means and the control electronics means; and (E) side mounting means extending between the upper mounting means and the electronics compartment means, the side mounting means for locating the electronics compartment means below an upper surface of a slide of the handgun, the side mounting means comprising:
  (i) user control means located on an exterior surface of the side mounting means and connected to the control electronics means for allowing a user to control the light projection means; and
  (ii) internal guide channel means for receiving and guiding at least one of wiring and an optical fiber through the side mounting means from the electronics compartment means to the upper mounting means;

wherein the sight is configured to be statically mounted to a frame of the handgun with sufficient clearance such that the sight does not interfere with operation of the slide of the handgun.

11. The sight of claim 10 wherein the light source means is located in the upper mounting means at the light projection means, the light source means for projecting light directly onto the lens means.

12. The sight of claim 10 wherein the light source means is located in the electronics compartment means, the at least one of wiring and an optical fiber comprising optic fiber means for conveying light from the light source means to the light projection means through the internal guide channel means.

13. The sight of claim 10 comprising battery compartment means located below a barrel of the handgun when the sight is mounted to the handgun, the battery compartment means for receiving the at least one battery means comprising at least one CR2 battery.

14. The sight of claim 10 comprising sight adjustment means for adjusting at least one of windage and elevation, wherein the sight adjustment means is located in the side mounting means.

15. The sight of claim 10 comprising laser sight means mounted within the electronics compartment means.

* * * * *